United States Patent [19]

Sapp

[11] Patent Number: 4,709,493

[45] Date of Patent: Dec. 1, 1987

[54] CLOCK WITH CALENDAR NOTEPAD

[76] Inventor: Charles E. Sapp, 2149 Rio Guacimal Ct., San Jose, Calif. 95116

[21] Appl. No.: 936,493

[22] Filed: Dec. 1, 1986

[51] Int. Cl.[4] ..... G09D 3/10

[52] U.S. Cl. ..... 40/117; 40/471; 40/518; 368/28; 368/40

[58] Field of Search ..... 40/112, 117, 471, 518; 368/28, 29, 30, 35, 31, 32, 33, 34, 40

[56] References Cited

U.S. PATENT DOCUMENTS

| | | | |
|---|---|---|---|
| 1,587,173 | 6/1926 | Nall et al. | 368/33 |
| 1,852,474 | 4/1932 | Norum | 40/117 |
| 2,016,022 | 10/1935 | Philippi | 40/117 |
| 2,215,552 | 9/1940 | Hostetler | 40/117 |
| 2,227,362 | 12/1940 | Parr et al. | 368/40 |
| 3,063,232 | 11/1962 | Cooney, Jr. | 368/40 |
| 3,353,347 | 11/1967 | Gates et al. | 368/40 |
| 3,608,300 | 9/1971 | Wingler | 368/35 |
| 3,633,298 | 1/1972 | Grier, Jr. | 434/324 |
| 4,026,053 | 5/1977 | Canon | 40/117 |
| 4,216,596 | 8/1980 | Brown | 40/118 |
| 4,381,614 | 5/1983 | Kebe | 40/118 |

*Primary Examiner*—John J. Wilson
*Assistant Examiner*—Michael Lynch

[57] ABSTRACT

A device having a housing with two columns of windows and a date window adjacent the top window of one of the columns. A roll of paper is disposed within the housing, with the opposed ends of the paper fixed to separate shafts. The shafts are rotatably connected to the housing and rotation of the shaft moves the midportion of the roll of paper past the windows. An end of each shaft protrudes from the housing to permit manual rotation of the shafts, and the opposed end of one shaft is fitted with an end member. The end member has a conical nose and radially outwardly extending projections. Adjacent to the end member is a clock having a bar attached to the hour shaft for rotation therewith. The bar has a sufficient length to contact the projections of the end member, thereby causing the paper to move from one shaft toward the other.

3 Claims, 7 Drawing Figures

CLOCK WITH CALENDAR NOTEPAD

TECHNICAL FIELD

The invention relates to clocks, and more particularly to a clock calendar for tracking personal dates.

BACKGROUND ART

Various methods are used to keep track of important dates from year to year. One such method is to buy a new date book every year and to copy birthdays, anniversaries and other yearly occasions from the outdated book to the new date book. The same can be done with wall calendars.

Devices for recording events which are to occur on a particular day are known. U.S. Pat. No. 3,633,298 to Grier describes an apparatus for scheduling appointments for a period of a week. Lined paper is passed under a frame member that divides the paper into a number of sections, each section representing a particular day of the week. The appointments are recorded according to the day in which they are to occur. At the end of the week the lined paper is removed from the ene of the frame and because the paper is part of a continuous roll of lined paper, clean paper replaces the removed paper. Positioned on the back panel of the frame is a group of sheets which are equivalent to a data book.

An object of the present invention is to provide a device which is a permanent recordation of important personal yearly dates and which gives a yearly reminder of the approach of such dates.

DISCLOSURE OF THE INVENTION

The above object has been met by a clock having a calendar notepad which, once the dates have been recorded, automatically provides a yearly reminder of important dates. Additionally, the device indicates the time of day and the present day of the year.

The invention includes a housing having a pair of adjacent columns of windows. Preferably, there are at least six windows in each column. In line with the top window of each column is a date window.

A roll of paper is disposed within the housing, with the opposed ends of the paper roll fixed to separate shafts. The shafts are rotatably connected to the housing so that rotation of a shaft will move the midportion of the roll of paper past the windows. A plate is positioned to ensure that the midportion of the paper roll is brought close to the windows. An end section of each of the shafts protrudes from the housing to permit manual rotation of shafts.

The roll of paper has a sequential list of the calendar dates positioned so that a single calendar date is readable in the date window at any one time. As a shaft is rotated the calendar dates sequentially move past the date window. As desired, a user inserts the names and ages of persons onto the roll of paper in such a position that permits the names and ages to be readable in the top window of the first column of windows when the birthday of those persons is readable in the date window. The same may be done for anniversaries, except that the information should be readable in the top window of the second column of windows when the date of the anniversary is readable in the date window.

A clock is attached to the housing near the upper shaft that supports the roll of paper. The upper shaft has an end member having a cone-shaped nose and a plurality of radially outwardly extending projections. A bar is attached to the hour shaft supporting the hour hand of the clock. Thus, the bar rotates with the hour hand. The bar has a sufficient length to contact the projections on the end member of the upper shaft. In this manner, the end member is rotated in intervals of twelve hours so as to draw the paper from the lower shaft toward the upper shaft. The calendar dates on the paper roll are spaced apart so that the date readable within the data window is changed every twenty-four hours.

A device as described above, having six windows in each of the pair of window columns, provides the birthdays and anniversaries of the present date and a reminder of birthdays and anniversaries that will occur within the following five days. Each window is labeled accordingly. A plaque at the top of the housing denotes the present year.

An advantage of the present invention is that once names and dates are recorded on the roll of paper the device provides a yearly reminder of upcoming occasions. Unless a user wishes to add new names to the list, only the plaque denoting the present year needs to be changed from year-to-year.

BEST MOST FOR CARRYING OUT THE INVENTION

Figure 1:
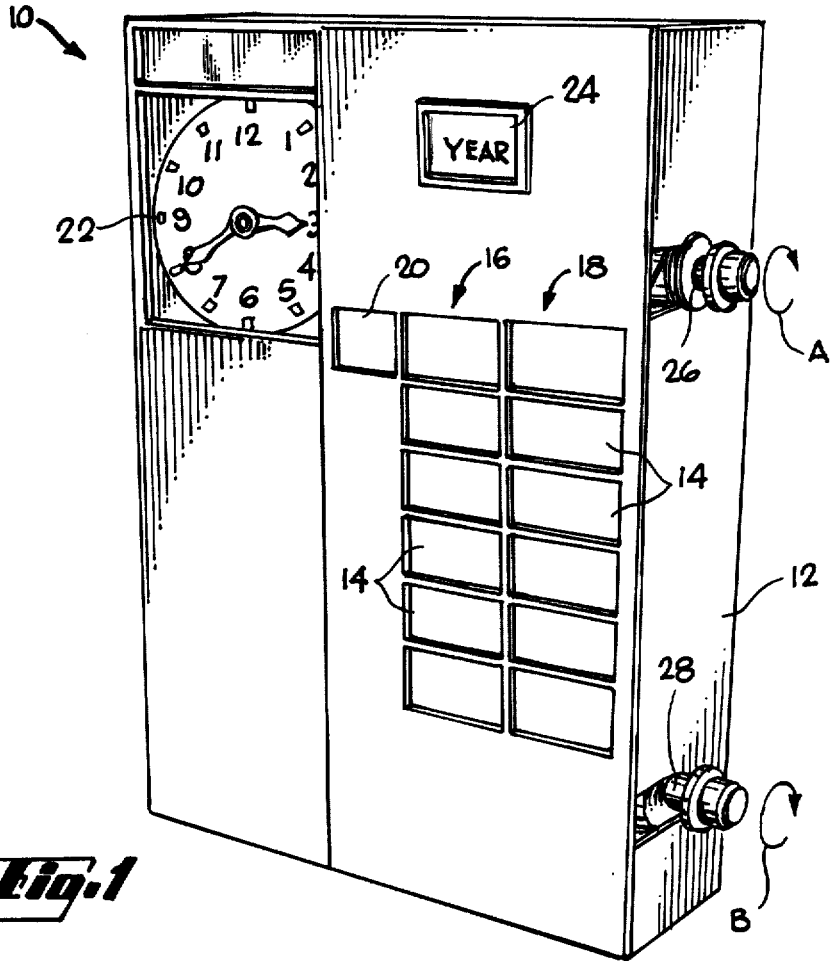
FIG. 1 is a perspective view of a device for keeping track of important dates, in accord with the present invention.

With reference to FIG. 1, the automatic occasion clock calendar 10 includes a housing 12 having a number of windows 14. The windows are arranged in a first column 16 of windows, a second column 18 of windows, and a single "date" window 20.

Attached to the housing 12 is a clock 22, providing the time of day, and a removable plaque 24 which denotes the present year. A pair of shafts 26 and 28 have end sections which protrude from the housing. The shafts are rotatably attached to the housing, as indicated by arrows A and B.

Figure 2:
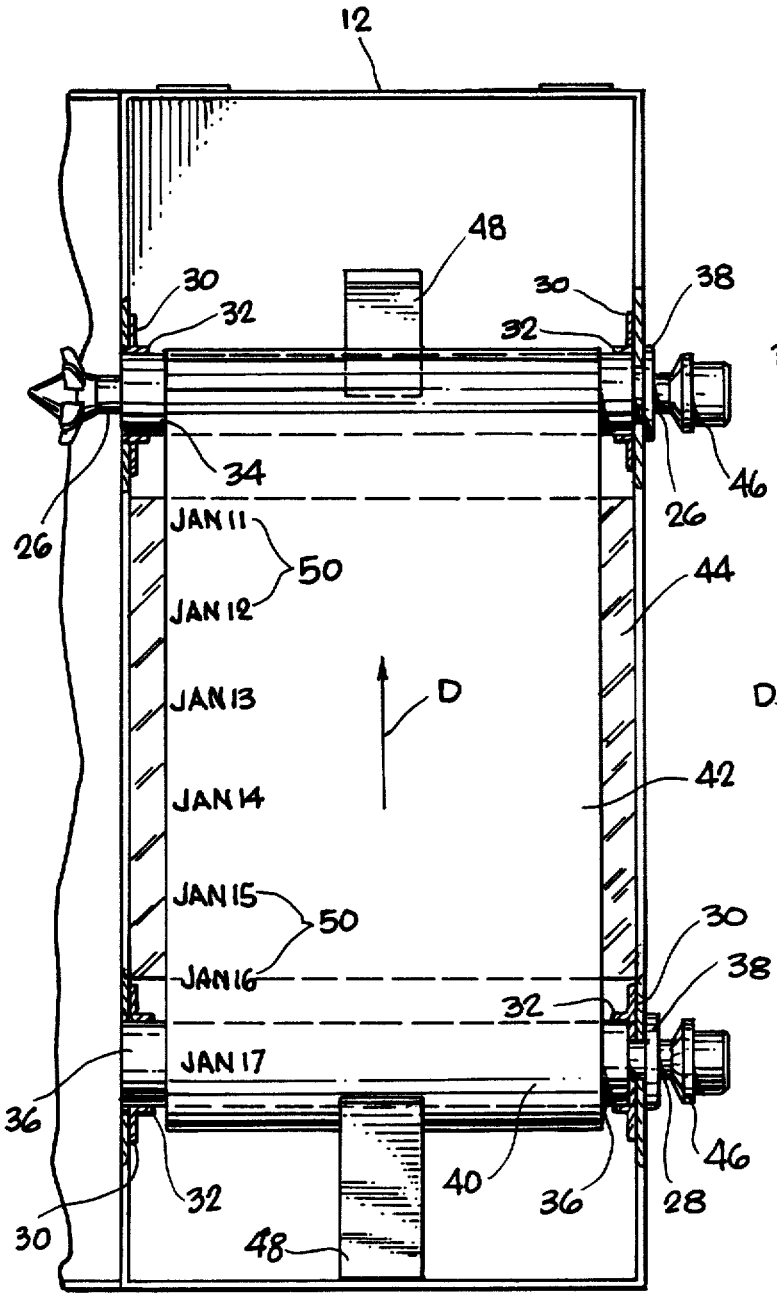
FIG. 2 is a front, cut-away view of the device of FIG. 1.
Figure 3:
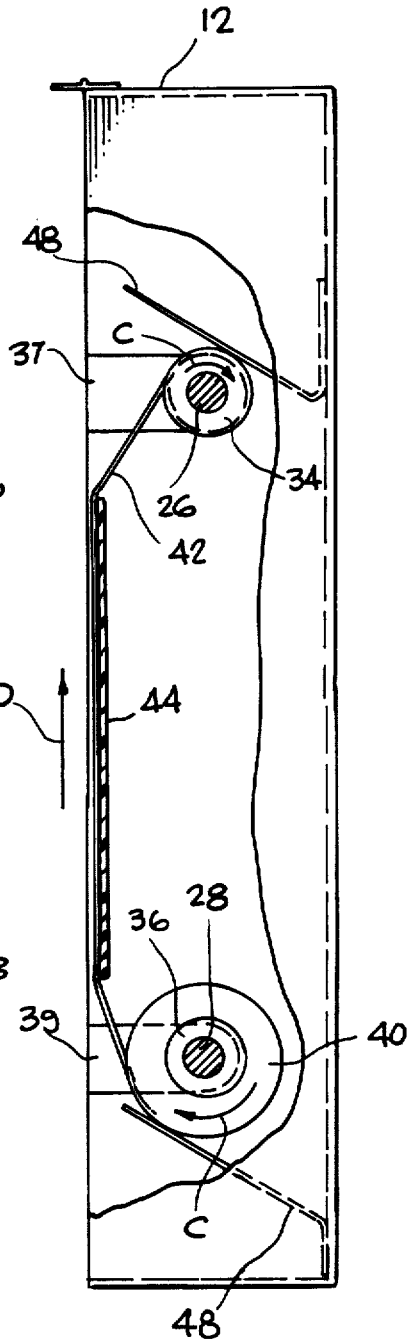
FIG. 3 is a side, sectional view of the device of FIG. 2.

Referring now to FIGS. 2 and 3, the shafts 26 and 28 are connected to plastic retainer members 30 having C-shaped cups 32 much in the manner of a window shade retainer. The C-shaped cups 32 frictionally contact spools 34 and 36 for rotation of the spools. The end sections of the shafts 26 and 28 which protrude from the housing 12 are prevented from moving laterally by flanges 38 which position the shafts within slots 37 and 39.

A continuous roll of paper 40 has a first end that is fixed to the upper spool 34 and a second end that is fixed to the lower spool 36. The midportion 42 of the roll of paper is positioned close to the front of the housing 12 by a clear plastic plate 44. Thus, as the shafts 26 and 28 are rotated clockwise, as indicated by arrows C, paper will move from the lower shaft 28 toward the upper shaft 26. This direction of paper movement is shown by arrows D.

The shafts 26 and 28 are fitted within the spools 34 and 36 so that rotation of a shaft will rotate the spools. Thus, paper may be transferred from one spool to the other by manually rotating the shafts. Knobs 46 are provided at the end of the shafts 26 and 28 to facilitate manual rotation. Flexible plastic members 48 frictionally contact the paper on the spools and act as brakes to ensure that the midportion 42 of the paper remains properly tensioned against the plastic plate 44 during and after rotation of the shafts.

Figure 4:
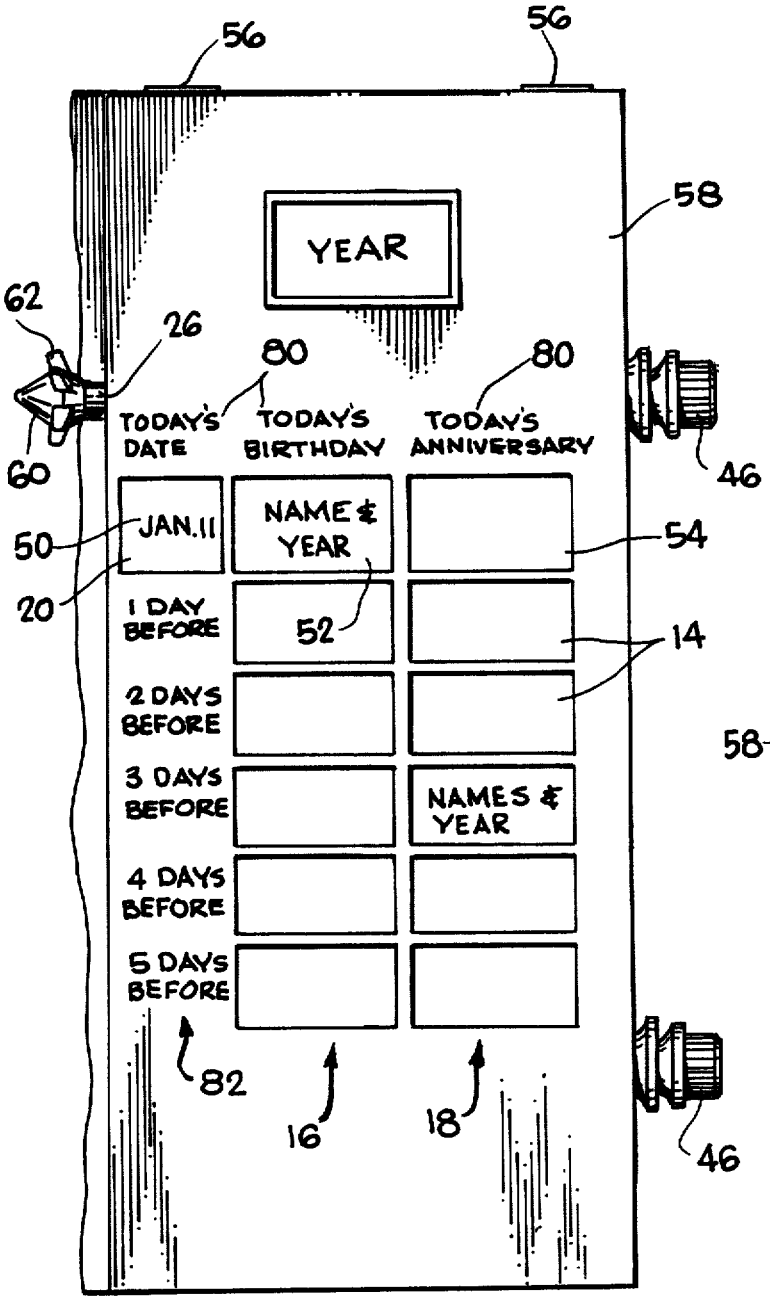
FIG. 4 is a front, partial view of the device of FIG. 1.
Figure 5:
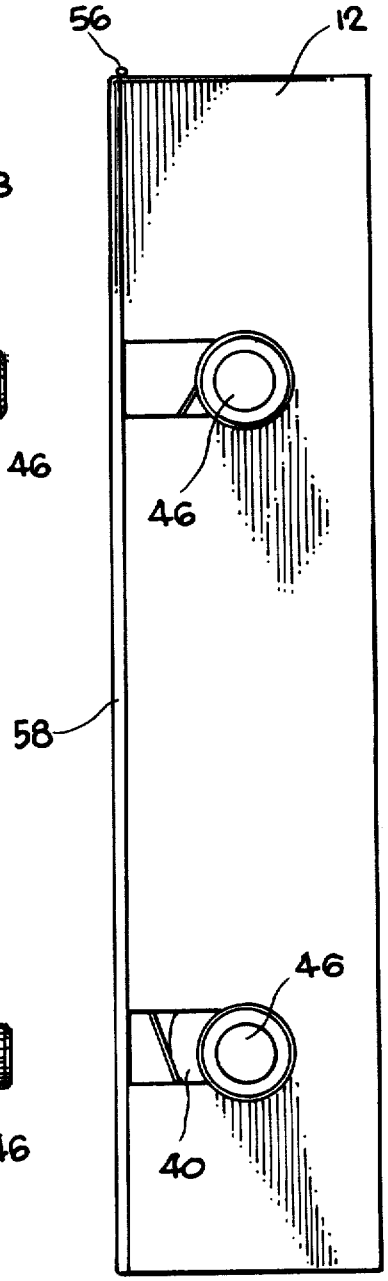
FIG. 5 is a side view of the device of FIG. 4.

The roll of paper 40 has a sequential list of calendar dates 50 printed down one side of the paper. Referring to FIGS. 4 and 5, a calendar date, January 11, may be read through the date window 20. In the top window 52 of the first column 16 of windows, the user may record the name and the year of birth of a person having a birthday on the Eleventh of January. Knobs 46 may then be rotated clockwise until the date of January 12 is readable within the date window 20. Once again, the names and years of birth of persons having a birthday on the readable calendar date may be recorded in window 52.

Likewise, the names of persons celebrating anniversaries are, as desired, recorded in the top window 54 of the second column 18 of windows. It is understood that an "anniversary" includes all events a user determines are worthy of yearly celebration. Most commonly, wedding anniversaries are recorded in the second column 18 of windows. In such a case the user would record the names of the spouses and the year of marriage.

To facilitate the initial recordation of all birthdays and anniversaries occurring during a year, the housing 12 has hinges 56 which permit the front surface 58 to be lifted away from the paper. A user may then use the clear plastic plate 44 as a platform to record the pertinent information next to as many as ten dates without being required to move the paper after each date's recordation.

Figure 6:
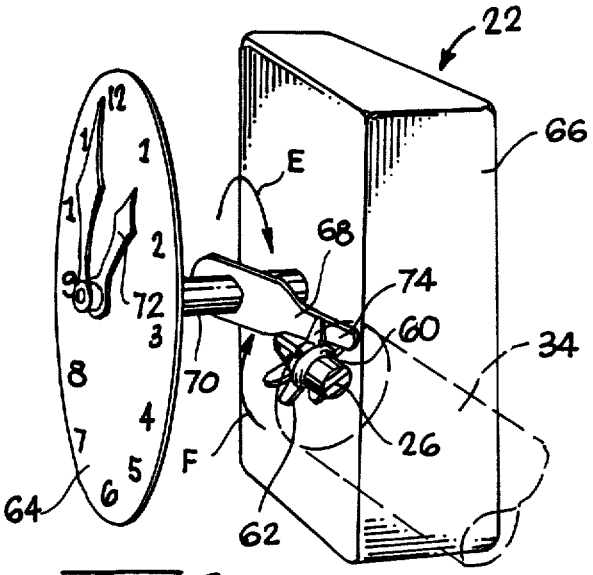
FIG. 6 is a perspective view of the clock of FIG. 1.
Figure 7:
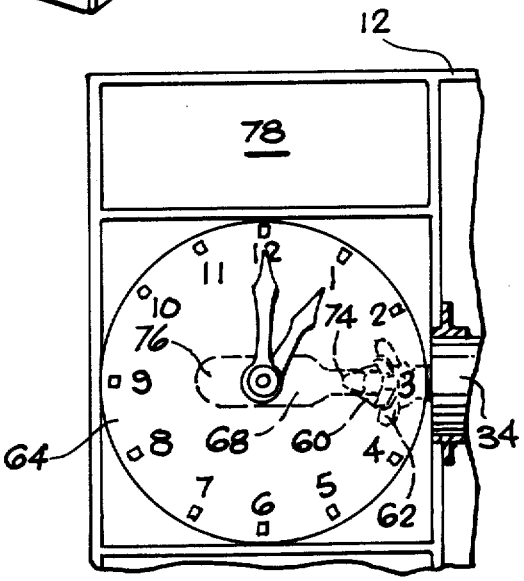
FIG. 7 is a front view of the clock of FIG. 6.

Fixed to the end of the upper shaft 26 opposite the knob 46 is an end member 60 having a cone-shaped nose and a number of radially outwardly extending projections 62. As may be seen in FIGS. 6 and 7, the end member 60 is fitted within the space between the face 64 and the workings 66 of the clock 22. A bar 68 is attached to the shaft (or more correctly, the sleeve) 70 which controls the hour hand 72 of the clock. The bar 68 has a length sufficient to make contact with the projections 62 each time the clock brings the bar to the three o'clock position. The bar 68 has a tapered end 74 which, because the end member 60 has a conical nose, does not apply force to portions of the end member other than the projections. Moreover, the bar has a counterbalance end 76. Thus, the bar will not interfere with proper timing by the clock 22.

Rotation of the bar 68, as shown by arrow E, will cause clockwise rotation of the upper shaft 26 and the spool 34, as indicated by arrow F. Preferably, the clock 22 is removable from the housing 12 so that the shaft 26 may be manually rotated without interference with the bar 68. Space 78 is provided for the storage of writing instruments or for gripping the device.

In operation, on the first day of the year the occasion clock calendar 10 is manually adjusted until the calendar date "Jan. 1" is readable in the date window 20. The clock 22 will cause the bar 68 to rotate the shaft 26 every twelve hours. After the second of these twelve hour intervals the calendar date "Jan. 2" will be readable in the date window.

FIG. 4 shows a first set of labels 80 above the windows. This first set of labels notes the significance of the information contained in the top row of windows. A second set of labels 82 notes how many days will pass before the recordation in a given row of windows 14 will be readable in one of the top windows 52 and 54. Thus, the automatic occasion clock calendar provides a remainder of an upcoming birthday or anniversary five days in advance.

The occasion block calendar is twelve inches in height and the housing is constructed of wood, but this is not critical. The device may be elongated and additional windows may be provided if more than a five day reminder is desired. Moreover, a third column of windows may be added if it is desired that the device give reminders of occasions besides birthdays and anniversaries.

I claim:

1. A clock calendar comprising, a housing having a front side, a plurality of windows on said front side of the housing, including a date window, a paper roll adjustably disposed within said housing, said paper roll having a list of calendar days printed thereon, means for positioning said paper roll within said housing such that a calendar day is readable within said date window and advancement of said paper roll causes a different day to be readable within the date window, said means for positioning the paper roll being a pair of rotatable shafts, said paper roll having a first end portion wrapped about a first rotatable shaft of said pair of rotatable shafts and having a second end portion wrapped about a second rotatable shaft, whereby rotation of said shafts causes the length of said paper roll between said end portions to move past said windows, said paper roll having blank space for the recordation of personal dates through windows other than date windows, and a clock in communication with said paper roll, said clock having a means for periodically advancing the paper roll, said means for periodically advancing the paper roll including a plurality of radially outwardly extending projections about the circumference of said first shaft and including a bar attached to said clock for rotation with the hour hand of the clock, said bar having sufficient length to communicate with said projections for rotation of said first shaft, wherein said bar is balanced upon a shaft to which said hour hand is fixed, whereby advancing of said paper roll causes the next calendar day to be readable within said date window and said recorded personal dates are caused to be brought forward toward said window adjacent said date window.

2. A clock calendar comprising, a housing having a front side, a first column of windows in said front side of the housing, said first column of windows having a top window, a second column of windows adjacent and parallel to said first column, said second column of windows having a top window forming a row with the top window of the first column, a date window in line with the row of windows formed by the top windows of said columns, a roll of paper disposed within said housing, said roll of paper supported by first and second shafts rotatably connected to said housing, a list of calendar dates disposed on said roll of paper to be readable in said date window, a recordation of personal indicia adjacent a particular calendar date, each personal indicia disposed on said paper roll to be readable in the top window of the first and second columns of windows when the date associated with the personal indicia is readable in the date window, a clock connected to said housing, and means for periodically rotating said first and second shafts, said means for periodically rotating said shafts including a plurality of radially outwardly extending projections on the circumference of said first shaft, wherein said projections extend from the circumference of a first end of said first shaft, said first end terminating in a conical configuration, said means for periodically rotates said shafts also including a bar in communication with the hour hand of said clock for rotation therewith, said bar having a length sufficient to contact said projections for rotation of said first shaft, said means for rotation causing the roll of paper to pass around said first shaft, thereby moving each following calendar date in the direction of a top window, said means for rotation causing a different calendar date to be readable in a top window every twenty-four hours.

3. A clock calendar comprising, a housing having a front side, a first column of windows in said front side of the housing, said first column of windows having a top window, a second column of windows adjacent and parallel to said first column, said second column of windows having a top window forming a row with the top window of the first column, a date window in line with the row of windows formed by the top windows of said columns, a roll of paper disposed within said housing, said roll of paper supported by first and second shafts rotatably connected to said housing, a list of calendar dates disposed on said roll of paper to be readable in said date window, a recordation of personal indicia adjacent a particular calendar date, each personal indicia disposed on said paper roll to be readable in the top window of the first and second columns of windows when the date associated with the personal indicia is readable in the date window, a clock connected to said housing, and means for periodically rotating said first and second shafts, said means for periodically rotating said shafts including a plurality of radially outwardly extending projections on the circumference of said first shaft and including a bar in communication with the hour hand of said clock for rotation therewith, said bar having a length sufficient to contact said projections for rotation of said first shaft, wherein said bar is balanced upon a shaft to which said hour hand is fixed, said means for rotation causing the roll of paper to pass around said first shaft, thereby moving each following calendar date in the direction of a top window, said means for rotation causing a different calendar date to be readable in a top window every twenty-four hours.

* * * * *

UNITED STATES PATENT AND TRADEMARK OFFICE

CERTIFICATE OF CORRECTION

PATENT NO. : 4,709,493

DATED : December 1, 1987

INVENTOR(S) : Charles E. Sapp

It is certified that error appears in the above—identified patent and that said Letters Patent is hereby corrected as shown below:

Column 1, line 23, "is removed from the ene" should read - -is removed from the end- -.

Column 1, line 27, "to a data book" should read - -to a date book- -

Column 2, line 8, "within the data" should read - -within the date- -.

Column 4, line 10, "remainder of an upcoming birthday" should read - -reminder of an upcoming birthday- -.

Column 4, line 12, "The occasion block calendar" should read - -The occasion clock calendar- -.

Claim 2, column 5, line 22, "means for periodically rotates said shafts" should read - -means for periodically rotating said shafts- -.

Signed and Sealed this

Fourteenth Day of June, 1988

*Attest:*

*Attesting Officer*

DONALD J. QUIGG

*Commissioner of Patents and Trademarks*